United States Patent [19]

Ciarcia

[11] 4,143,256

[45] Mar. 6, 1979

[54] ARC CHUTE HAVING PLATES COATED WITH WELD DETERENT MATERIAL

[75] Inventor: Ronald D. Ciarcia, Bristol, Conn.

[73] Assignee: General Electric Company, New York, N.Y.

[21] Appl. No.: 778,420

[22] Filed: Mar. 17, 1977

[51] Int. Cl.[2] ..... H01H 33/08

[52] U.S. Cl. ..... 200/144 R; 200/144 C; 200/149 A

[58] Field of Search ..... 200/144 C, 149 A, 144 R

[56] References Cited

U.S. PATENT DOCUMENTS

| | | | |
|---|---|---|---|
| 2,531,007 | 11/1950 | Strom et al. | 200/144 C |
| 2,645,693 | 7/1953 | Cole et al. | 200/144 C |
| 2,816,990 | 12/1957 | Gelzheiser | 200/144 C |
| 2,911,505 | 11/1959 | Legg et al. | 200/144 C |
| 2,934,629 | 4/1960 | Bonnefois et al. | 200/144 C |
| 3,213,254 | 10/1965 | Strom | 200/144 C |
| 3,801,760 | 4/1974 | Korte | 200/144 C |

FOREIGN PATENT DOCUMENTS

| | | | |
|---|---|---|---|
| 895202 | 5/1962 | United Kingdom | 200/144 C |

*Primary Examiner*—Robert S. Macon
*Attorney, Agent, or Firm*—Robert A. Cahill; Walter C. Bernkopf; Philip L. Schlamp

[57] ABSTRACT

An arc chute for assisting in the extinction of an arc drawn between circuit interrupting contacts opening in air includes a stack of closely spaced metallic plates coated with a weld deterent material, such as silicone varnish. By virtue of this coating, the propensity of metal particles condensed from the metal vapor generated by the arc to weld to the arc plate surfaces is reduced. Consequently, material degradation of the arc chute dielectric strength is avoided, and arc reignition is discouraged.

7 Claims, 3 Drawing Figures

ARC CHUTE HAVING PLATES COATED WITH WELD DETERENT MATERIAL

BACKGROUND OF THE INVENTION

Extinction of a violent, high energy arc drawn between circuit interrupting contacts opening in air to interrupt the flow of large fault currents is an extremely formidable task. Such an arc must be extinguished quickly to prevent damaging consequences to the electrical wiring and load, as well as to the circuit interrupting device itself. As the current availables are increased by the electrical utilities, the potential magnitudes of fault currents correspondingly increase, and thus the current interrupting capacities of circuit interrupting devices must be upgraded commensurately.

For low voltage alternating current circuit interrupting devices, i.e., up to 600 volts AC, it is common practice to utilize an arc chute composed of a stack of closely spaced metallic plates positioned along the path of an arc drawn between the contacts as they are opened to interrupt current flow in a circuit. The magnetic field associated with the arc current interacts with the arc plates to draw the arc into the chute. As the arc encounters the arc plates, it is chopped up into a series of arclets drawn between adjacent plates, each arclet having its own anode-cathode voltage drop contributing to an increase in the arc voltage. Moreover, the arc plates function to cool the arc, thus enhancing deionization with consequent increase in the arc path resistance. The arc plates also cause a turbulent mixing of the hot arc gases and the relatively cool air in the spaces between the plates through which the arclets move, thus further promoting deionization.

For a successful interruption, all of these factors must have the cumulative effect of not only extinguishing the arc, but also of sufficiently deionizing the gases in the gap between the separated contacts so as to prevent reignition or restrike of the arc into the next current half cycle after a current zero. In other words, the circuit interrupting device must operate to raise the voltage gradient in its contact gap to a level permanently in excess of the system recovery voltage to prevent arc restrike.

It is believed, in the case of extremely high fault current interruption, that the arc is so large that the arc plates are ineffective in chopping the arc into arclets. That is, ionization of the gases is so complete that, when the arc encounters the front edges of the plates, it does not root on the plates, but simply travels around the front edges of the plates. The arc thus assumes a serpentine path as it bulges outwardly in the spaces between arc plates. This serves to elongate the arc and thus increase path resistance, but the benefit of the anode-cathode voltage drops associated with the creation of arclets is not thought to be achieved in the case of extremely high energy arcs. Consequently, the major contribution of the arc plates in this situation is in achieving deionization of the arc path through cooling of the arc.

Regardless of whether or not arclets are formed, the extreme heat of the arc vaporizes the metal of the arc plates. Ideally this metal vapor along with the other arc gases would be exhausted out of the back of the arc chute before condensing. Unfortunately, this is not the case in practice. The condensed vapor forms molten metal spheres which can and in fact do weld as metal particles to the arc plates. Further condensation causes a build-up in the sizes of these welded particles to the extent that, on occasion, they become so enlarged as to actually bridge the gaps between adjacent arc plates. The existence of these welded particles saps the dielectric strength of the arc chute, and, if extensive, will jeopardize the gap dielectric strength to the extent that arc restrike may not be prevented. Even if restrike is avoided, the condition of the arc plates will be such that a subsequent attempt to interrupt a large fault current will so exacerbate the number and sizes of the welded metal particles that arc restrike can not be avoided.

It is accordingly an object of the present invention to provide an improved arc chute for circuit interrupting devices.

A further object is to provide an arc chute of the above-character which is capable of extinguishing a violent, high energy arc while maintaining sufficient dielectric strength to prevent arc restrike.

Yet another object of the present invention is to provide an arc chute of the above-character which is capable of maintaining its dielectric integrity over plural high fault current interruptions.

A still further object is to provide an arc chute of the above-character which is equipped to discourage the welding of condensed metal particles to its arc plates.

Other objects of the invention will in part be obvious and in part appear hereinafter.

SUMMARY OF THE INVENTION

In accordance with the present invention, there is provided an improved arc chute for assisting in the extinction of an arc drawn between contacts of a circuit interrupting device, such as a circuit breaker, opening in air to interrupt fault currents of short circuit proportions. The arc chute comprises a plurality of closely spaced, substantially parallel metallic arc plates or grids formed of, for example, steel which are mounted as a stack between insulative sideplates. The arc chute is positioned to distribute the front edges of the arc plates generally along and in proximity to the initial path of the arc drawn between the opening contacts. Preferably, the front edges of the plates are provided with aligned notches through which the movable contact of the circuit breaker swings in its movements away from the stationary contact during a circuit interruption.

To dramatically improve the arc extinguishing capability of the arc chute and thus the current interrupting capacity of the circuit breaker, in accordance with the present invention, the arc plates are coated over their entire surfaces with a high temperature resistant, weld deterent material, such as silicone varnish. I have discovered that this coating has the extremely beneficial effect of discouraging the propensity for metal particles condensed from the metal vapor generated by the extreme arc temperature to weld to the arc plate surfaces. That is, by reducing the tendency for condensed metal particles to weld to the arc plates, the vast majority are carried through and exhausted out the back of the arc chute by the wind generated by the arc. The resulting significant reductions in the prevalence and sizes of metal particles welded to the arc plates serves to preserve the dielectric strength of the arc chute and thus prevent arc restrike, as well as to permit subsequent successful interruptions of high fault currents.

I have also found that the presence of such a high temperature resistant, weld deterent coating on the arc plates does not noticeably diminish the efficacy of the arc plates in initially extinguishing the arc. That is, interaction of the arc associated magnetic field with the arc plates to motivate the arc into the arc chute is nevertheless achieved. The requisite cooling of the arc to promote deionization is not jeopardized by the coating, and, for less violent arcs, rooting of the arc on the arc plates pursuant to breaking the arc up into arclets is not impeded.

It has been found advantageous to likewise coat the sideplates with the same weld deterent material so as to reduce the possibility of arc tracking. This coating, by virtue of its high temperature resistance, also protects the insulative sideplates from the deleterious effects of the extreme arc temperature.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawing, in which.

DETAILED DESCRIPTION

Figure 1:
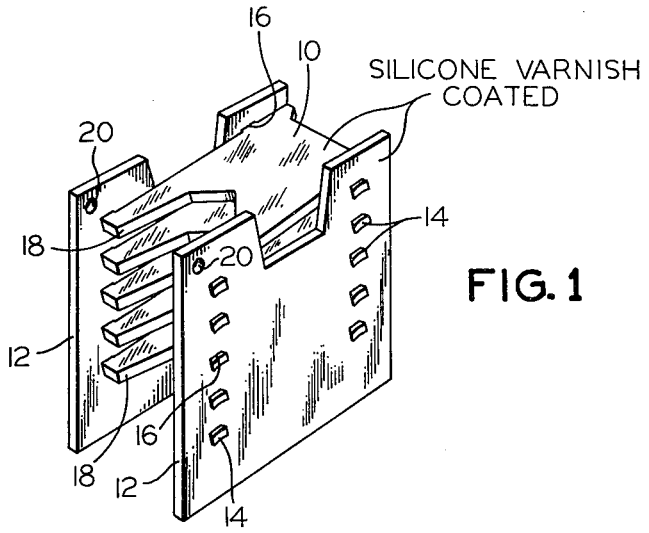
FIG. 1 is a perspective view of an arc chute to which the weld deterent coating of the present invention is applicable.

FIG. 1 illustrates an arc chute such as is incorporated in low voltage circuit interrupting devices, such as molded case circuit breakers. The arc chute includes a plurality of arc plates 10 of magnetic material, for example steel, which are mounted in parallel, closely spaced relation between insulative sideplates 12. The arc plates include laterally extending tangs 14 which extend through openings 16 in the sideplates; the free ends of the tangs being staked to maintain the plates in stacked assembly as is conventional practice. As is also common practice, the front edges of the arc plates are all provided with vertically aligned notches, as indicated at 18, to afford clearance for the movement of the movable contact (not shown) of a circuit breaker as it swings away from a stationary contact (not shown) pursuant to effecting a circuit interruption.

In accordance with the present invention, the arc plates 10, and preferably also the sideplates 12, are completely coated with a high temperature resistant, weld deterent material. An eminently suitable coating material has been found to be silicone varnish, such as manufactured by the Silicone Products Department of the General Electric Company under the designation SR-80. Silicone varnish is able to withstand temperatures up to 700°-800° Centigrade which is sufficient temperature resistance to remain coated over surface portions of the arc plates not directly subjected to an arc. It dries reasonably rapidly to tough durable finish with excellent bonding strength.

While the application of silicone varnish to the arc chute may be accomplished in a number of ways, I have found that simply dipping the arc chute in a silicone varnish bath is quite adequate and efficient on a production basis. Holes 20 may be provided in the upper front corners of the sideplates through which a wire (not shown) is strung for purpose of suspending the arc chutes during the dipping operation and subsequent drying. The coating may be air dried at room temperature for two hours or oven dried for 5-15 minutes at 150° C. A coating thickness of, for example, three mils, which can be readily achieved with a single dipping of the arc chute in the silicone varnish bath, has been found adequate for purposes of the present invention. Thicker coatings achieved through multiple dippings may be utilized.

Figure 2:
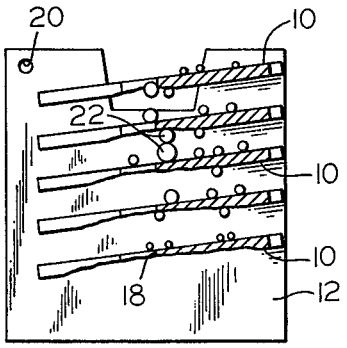
FIG. 2 is a sectional view of the arc chute of FIG. 1, illustrating its condition after being subjected to a violent arc without having the benefit of the present invention.

FIG. 2 is typical of the condition of the arc chute of FIG. 1 after being subjected to a high energy arc without having been previously coated with a weld deterent material in accordance with the present invention. It is noted that the lower arc plates, which experience the brunt of the arc, are materially eroded away by the extreme heat. The metal vaporized predominantly from the lower arc plates rises and flows between the arc plates toward the rear of the arc chute. Unfortunately, a significant portion of the metal vapor condenses before it can be exhausted from the arc chute. The condensed metal forms molten spheres which readily fuse or weld as particles to the surfaces of the arc plates as illustrated in FIG. 2. As the arc persists, more arc plate material is vaporized and then condensed, creating additional particles welded to the plate surfaces, as well as building up the sizes of the particles already welded to the plates. On occasion, the particles become so enlarged as to actually bridge the air gap between adjacent plates, such as is indicated at 22. It will be appreciated that the presence of these welded particles in substantial numbers and sizes materially reduces the dielectric strength of the arc chute, particularly if the particles form conductive paths shorting out adjacent plates.

Further aggravating the situation is the deleterious effects the arc has on the sideplates 12. The extreme heat of the arc can actually char the sideplates, thus degrading their insulating properties. The arc can produce tracks on the sideplates surfaces between arc plates which can conduct sufficient post arc current to trigger an arc restrike between the contacts. Moreover, the arc gases can escape through the tang holes 16 and condense on the outer surfaces of the sideplates to form conductive carbon and metallic paths between the tangs.

The cumulative effect of the metal particles welded to the arc plate surfaces and degradation of the sideplate insulative properties is to render the arc chute incapable of maintaining the requisite dielectric strength to prevent arc restrike following an initial arc interruption at a current zero. With re-establishment of the arc, the condition of the arc chute is worsened, and arc restrike following the next current zero cannot possibly be prevented. As a consequence, a successful interruption is not achieved.

Figure 3:
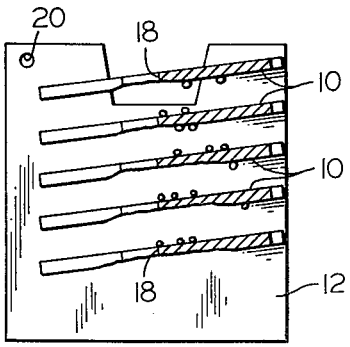
FIG. 3 is a sectional view of the arc chute of FIG. 1, illustrating its condition after being subject to a violent arc while having the benefit of the present invention.

FIG. 3 depicts the condition of the arc chute after a high fault current interruption, wherein the arc chute was first coated according to the present invention with a weld deterent material such a silicone varnish. It is noted that the lower arc plates are eroded away to substantially the same degree as in the case of the arc chute of FIG. 2, however the prevalence and size of the metal particles welded to the arc plate surfaces are dramatically reduced. While the presence of the coating is not believed to have any effect on the number of particles condensing from the metal vapor before existing the arc chute, the coating is instrumental in discouraging these particles from welding to the plate surfaces. Failing to weld to the plate surfaces, these particles are carried through and out the back of the arc chute by the extreme draft created by the arc.

I also find that the condition of the sideplates following a high fault current interruption is also dramatically improved due to presence of the coating. The instances of charring of the sideplates surfaces are significantly reduced. Since the coating is markedly less susceptible to arc tracking than the typical sideplate material, such as a compressed high density alpha-cellulose fiber, the possibility of creating conductive paths over the inner surfaces of the sideplates between adjacent plates is significantly reduced. Moreover, it is found that the coating is effective in sealing the tang holes in the sideplates, thus preventing the passage of arc gases therethrough and therefore the existance of conductive deposits on the outer surfaces of the sideplates is minimized.

The net result of the existence of the weld deterent coating on the surfaces of the arc plates and sideplates of the arc chute is to preserve the arc chute dielectric strength in the face of a high energy arc such that the capability of preventing arc restrike is materially enhanced. As a specific example, a circuit breaker equipped with arc chutes coated in accordance with the present invention was successful in interrupting a 10,000 ampere fault current at 240 volts, whereas the same circuit breaker equipped with uncoated arc chutes was not. While I prefer to use silicone varnish as the arc chute coating material, the characteristics of tetrafluoroethylene (Teflon) clearly indicate its suitability for utilization in my invention. Also a phosphate treatment of the arc plates to produce an iron oxide film on the steel plate surfaces should also provide the desired weld deterent property. Other high temperature, weld deterent coating materials will readily occur to those skilled in the art.

While I have disclosed separate insulative sideplates for mounting the arc plates, it will be appreciated that the arc plates could be mounted in the requisite manner by portions of the insulative mold case of a circuit breaker. In this case, such case portions should be coated, such as by spraying, with the same weld deterent material as the arc plates.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawing shall be interpreted as illustrative and not in a limiting sense.

Having described my invention, what I claim as new and desire to secure by Letters Patent is:

1. An arc chute for utilization in a circuit interrupting device to extinguish an arc created during a circuit interruption, said arc chute comprising, in combination:

A. a plurality of metallic arc plates;

B. insulative means mounting said arc plates in closely spaced, parallel relation; and C. a high temperature resistance, weld deterent, exterior coating completely covering all exposed surfaces of said arc plates, said coating being sufficiently thin to permit arc penetration thereof and cooling of the arc by said metallic arc plates.

2. The arc chute defined in claim 1, wherein said insulative mounting means includes a pair of sideplates, and said coating also completely covers all exposed surfaces of said sideplates.

3. The arc chute defined in claim 1, wherein said coating is silicone varnish.

4. The arc chute defined in claim 1, wherein said coating is tetrafluoroethylene.

5. The arc chute defined in claim 1, wherein said arc plates are formed of steel, and said coating is an iron oxide film.

6. The arc chute defined in claim 2, wherein said coating is silicone varnish.

7. The arc chute defined in claim 1, wherein said coating is on the order of 3 mils thick.

* * * * *